United States Patent [19]

Davies et al.

[11] 4,165,979

[45] Aug. 28, 1979

[54] FLASH SMELTING IN CONFINED SPACE

[75] Inventors: Haydn Davies, Fonthill; Jose A. Blanco, Sudbury; Charles E. O'Neill, Mississauga, all of Canada

[73] Assignee: The International Nickel Company, Inc., New York, N.Y.

[21] Appl. No.: 953,546

[22] Filed: Oct. 23, 1978

Related U.S. Application Data

[63] Continuation-in-part of Ser. No. 879,344, Feb. 21, 1978, abandoned.

[51] Int. Cl.[2] ..... C22B 5/08

[52] U.S. Cl. ..... 75/23; 75/26; 75/74; 75/82; 75/92; 266/44; 266/189

[58] Field of Search ..... 75/23, 74, 82, 72, 73, 75/26, 92; 266/189, 172, 171, 44

[56] References Cited

U.S. PATENT DOCUMENTS

| | | | |
|---|---|---|---|
| 2,668,107 | 2/1954 | Gordon et al. | 75/74 |
| 3,459,415 | 8/1969 | Holeczy et al. | 75/73 |
| 3,674,463 | 7/1972 | Yannopoulos | 75/74 |
| 3,796,568 | 3/1974 | Szekely et al. | 75/72 |
| 4,073,645 | 2/1978 | Fritsch et al. | 75/23 |

*Primary Examiner*—M. J. Andrews

*Attorney, Agent, or Firm*—Lewis Messulam; Ewan C. MacQueen

[57] ABSTRACT

Use of a burner design featuring a tunnel of high length to diameter ratio enables the flash-smelting of sulfides to be carried out in a much more confined space than heretofore possible.

8 Claims, 1 Drawing Figure

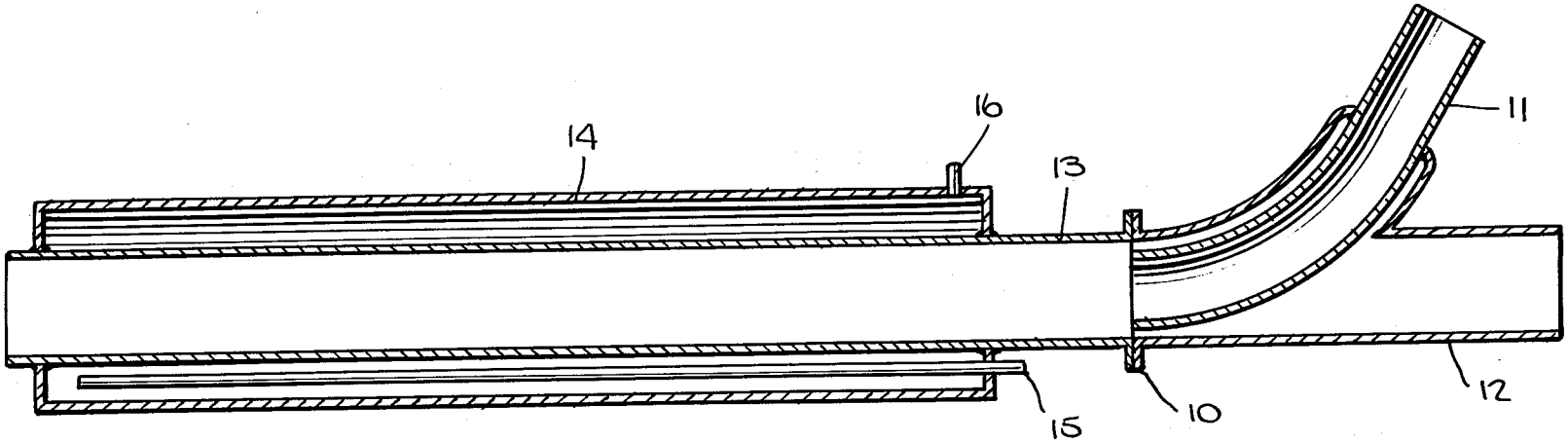
14
16
13
11
10
15
12

FLASH SMELTING IN CONFINED SPACE

This is a continuation-in-part of our application Ser. No. 879,344, filed Feb. 21, 1978 now abandoned.

BACKGROUND OF THE INVENTION

The present invention relates to an improved process for flash-smelting sulfidic materials which contain copper and/or nickel as well as iron. It is particularly, though not exclusively, suitable for incorporating in a pyrometallurgical copper recovery process wherein smelting and converting are carried out in the same vessel.

In the course of recovering copper and/or nickel from sulfidic materials such as concentrates containing chalcopyrite, pyrrhotite, pentlandite, etc., the first pyrometallurgical step needed is smelting to oxidize iron and slag it off, thereby leaving a matte which is subsequently converted by blowing it with an oxidizing gas. Of the various smelting techniques known, one of the most attractive comprises flash-smelting with the aid of substantially pure oxygen, as described, for example, in Canadian Pat. No. 503,446. Such a technique which involves injection of the particulate sulfide with a stream of oxygen into the interior of a furnace chamber, where the sulfide 'burns' autogenously while in a state of suspension, has the obvious attraction of fuel economy. Furthermore, the use of pure oxygen leads to offgases which are concentrated in sulfur dioxide so that the latter can be removed economically, for example, by liquefaction. Such a flash-smelting procedure has in fact been used commercially for some time by the present Assignee in its operations at Sudbury, Ontario, Canada. After the flash-smelting, the matte is converted in either a side-blown (Pierce-Smith) or a top blown vessel with the aid of oxygen or oxygen-enriched air. The furnace used currently for the flash-smelting is externally about 24 meters long, 7 meters wide and 5.5 meters high at the top of its arched roof. As a result, the process is suited only to production on a large scale, such as the treatment of one or two thousands of tonnes of concentrate daily. In the case of production on a more modest scale, the large capacity of a flash-smelter is inappropriate, and the need for separate smelting and converting vessels can make the capital costs prohibitively high. Ideally it is desirable, for small scale production, to perform both operations in a single vessel.

Various approaches have been suggested for enabling smelting to take place in a converter. These approaches can be divided into those involving batch processing and those involving continuous processing. The former category includes schemes wherein concentrate to be smelted is fed into a converter, either alone or in admixture with some matte to be converted, the converter having a starting bath of molten matte already present therein. This need for a starting bath is a distinct inconvenience inasmuch as it necessitates either a prior melting operation in a separate vessel, or a melt-down cycle in the converter vessel which is inherently an inefficient procedure. While the alternative resort to continuous or semi-continuous operation minimizes the inconvenience of the start-up bath, it no longer permits operation with a single vessel; instead it involves using two converter vessels in series.

The need for a start-up bath of molten matte does not arise when flash-smelting is resorted to since the oxidative 'burning' reaction takes place not within the molten bath but rather in the furnace space above the matte, in what may be termed the 'flame-zone'. It would therefore be highly desirable to be able to carry out flash-smelting in a vessel such as a Pierce-Smith converter and thereafter convert in the same vessel. The reason why such an approach has never been attempted stems from a universal belief that the flame-zone at the end of a flash-smelting gun could never be accommodated in such a confined space. Hence directing a flash-smelting gun into a converter vessel would be expected to cause a flame-zone which would impinge on the refractory of the vessel and cause refractory burn-out in a very short time. Moreover, the effect of such impingement coupled with the rapid injection of large quantities of gas and solids would be expected to lead to unacceptable dust-creation.

We have found, however, that by suitable modification to the burner and its method of operation flash-smelting can be made to take place within a much smaller and well defined flame-zone, small enough to be accommodated in a typical converter vessel.

SUMMARY OF THE INVENTION

The present invention provides an improved process for flash-smelting sulfides by suspending the sulfides together with a fluxing agent in an oxidizing gas stream containing free oxygen and injecting the suspension into a furnace chamber, wherein formation and injection of said suspension is accomplished by at least one burner which comprises a first conduit through which particulate sulfide and fluxing solids are fed, a second conduit through which oxidizing gas is fed, and a mixing tunnel having an inlet extremity which communicates with said conduits to receive said particulate solids and oxidizing gas and an outlet extremity which communicates with said furnace chamber to discharge said suspension thereinto wherein said mixing tunnel comprises a tunnel cooled by water or other suitable fluid and having a length of at least ten times its internal diameter, and wherein said suspension is injected through said tunnel at a linear velocity of at least 25 meters per second.

The term 'chamber' is used herein to designate the space above the level of any pool of molten slag and matte in the vessel, since the stream of concentrate in oxidizing gas must be injected into such free space, and the feed material should ideally have fully reacted with the gas stream before it contacts the pool of slag and matte in the vessel.

The invention will now be more specifically described with reference to the accompanying drawing.

BRIEF DESCRIPTION OF THE DRAWING

The accompanying drawing schematically illustrates the design of a burner which can be used in the process of the invention.

DETAILED DESCRIPTION OF THE EMBODIMENTS

The burner illustrated can be considered, for convenience, as consisting of a feed section and a mixing section, these sections being identified as those portions lying to the right and left respectively of a flange 10 as viewed in the drawing. The feed section consists of an arrangement of pipes 11 and 12 which terminate in a concentric manner in the vicinity of the flange 10. The pipe 11 is used for feeding particulate solids (i.e., sulfides and fluxing agent) to the furnace, while the pipe 12 carries the stream of oxidizing gas used for the process.

The design of the feed section results in particulate solids being injected into the mixing section of the burner out of a central aperture surrounded by an annular gas-feeding aperture.

The mixing section of the burner comprises a relatively long metallic tube 13 constituting the mixing tunnel. This tunnel is jacketed by a cooling chamber 14 provided with inlet and outlet 15 and 16 respectively through which water or any other suitable coolant can be circulated in practice. The relative dimensions of the tunnel 13 are essential to success of the process of the invention and constitute the most significant difference between our process and conventional flash-smelting. In accordance with the present invention the tunnel 13 must be of a length which is at least 10 times, and preferably 20 or even 30 times, its internal diameter. By way of comparison it should be noted that whenever in the past flash-smelting has been carried out with burners which include a mixing tunnel, the latter has been a tube only 3–4 times as long as its internal diameter.

It will be appreciated by those skilled in the art that the invention is by no means restricted to the burner design illustrated. Thus, burners having different feed section design may be used providing they are equipped with an appropriate mixing tunnel. Moreover, while the mixing tunnel illustrated is a cylindrical pipe, tunnels which have a non circular cross section or which have slightly divergent rather than parallel walls can be used, providing in such cases that the tunnel length is at least 10 times the average diameter of the tunnel.

The use of a burner which includes a tunnel of long narrow configuration results in a coherent stream wherein flash-smelting takes place within a flame-zone which is confined both longitudinally and laterally of the flow of the gas stream. It can be described as a far more focused flame-zone than is obtained with a conventional burner design and it has been visually observed to have a divergence of only about 6° near the tip. While it is difficult to measure accurately the longitudinal extent of the flame-zone, an analysis of 'droplets' collected from various positions in front of the burner gives a good indication of the spread of the zone. By doing such an analysis we have found that when the burner has a length to diameter ratio of about 30, material collected at 2 meters or more from the burner tip was fully reacted. Thus the flame-zone does not appear to extend beyond 2–3 meters from the burner tip.

The other important feature of the process of the invention is the linear flow rate through the burner tunnel of the stream of particulate solids suspended in the oxidizing gas. It is particularly critical when, in accordance with a preferred feature of the invention, the smelting is carried out in a top-blown rotary converter and the off-gases are therefore moving countercurrently to the injected stream. The stream velocity is at least 25 m/sec and preferably 30 m/sec or higher, in contrast with conventional flash-smelting where the stream velocity is usually about 20 m/sec. The higher velocity ensures that ignition does not take place within, or too close to, the discharge tip of the burner, and appears to produce a more coherent stream of oxygen and solids which is less subject to deflection by the off-gases. Thus with a stream velocity of 25 m/sec or more the flame-zone is kept at a finite distance, of the order of a few centimeters, from the burner tip, despite the countercurrent flow of the off-gases.

By adhering to the above-mentioned criteria we have found it possible to use a small converter vessel for flash-smelting a concentrate and the life of the vessel's refractory lining was found to be comparable to its normal life expectance, i.e., when the vessel is used for converting matte smelted in a different vessel.

The important benefit of achieving a smaller and better defined flame-zone can be realized regardless of the size of the furnace chamber in which smelting is performed.

Thus, one application of the present invention might lie in incorporating a plurality of burners of appropriately high length to a diameter ratio in a conventional flash-smelting furnace, such as that described in the above-mentioned Canadian Patent. Because of the shortness of the flame-zone, the burners need not be arranged with their axes horizontal, but some or all of them can be disposed vertically to protrude into the furnace chamber through the roof of the furnace.

However, the clearest benefit to be derived from the smallness of the flame-zone is of course the ability to use a converter vessel for the smelting. If the vessel in question is a side-blown converter, the necessary modification may consist in equipping it with a burner of appropriate high length to diameter ratio in one or both of its endwalls, and directed to the opposite end. Thus where two burners are used at opposite ends, they would be directed towards one another horizontally and at right angles to the direction of discharge of the tuyeres located in the side walls of the vessel and used for subsequent converting.

In a preferred embodiment of the invention a top-blown rotary converter is used to carry out the smelting. A detailed description of such a vessel is given in a paper by R. A. Daniele and L. H. Jaquay, presented at the AIME Annual Meeting of February 1972, and entitled "TBRC, A New Smelting Technique". Briefly the vessel can be described as a generally cylindrical container mounted to be fully rotatable about its longitudinal axis, which in operation is disposed at an angle of about 15°–20° to the horizontal. The lower end of the vessel is closed while its upper end is an open mouth through which charge is fed and oxidizing gas is blown, the mouth being fitted with an exhaust hood. To use the vessel for flash-smelting, the appropriate burner is inserted through the exhaust hood to protrude into the furnace chamber and lie generally alongside the lance used during the converting cycle. Thus with such an arrangement, the longitudinal axis of the burner is directed at a shallow angle to the surface of any matte (or slag) in the vessel. Of course the burner must not protrude too deeply into the furnace chamber since sufficient empty space must exist to accommodate the flame-zone between the burner tip and the furnace walls or melt surface.

As in conventional flash-smelting practice, the concentrate to be treated is injected into the flame-zone together with an appropriate flux. It is preferred that the flux used contain some magnesia since the latter aids in minimizing attack on the refractory lining of the converter. Thus an appropriate flux might comprise a mixture of silica and dolomite. Slow rotation of the furnace during operation helps to minimize the wear of the lining, as is well known for this type of furnace.

The stream used to inject the concentrate-flux mixture is perferably commercially pure oxygen, containing e.g., at least about 95% oxygen, since this ensures autogenous smelting as well as concentrated off-gases. The ratio of oxygen to concentrate will, of course, be selected to achieve the desired matte grade. If a particularly high grade of matte is to be produced, a cooling effect may be needed to avoid excessive temperature rises in the converter. The cooling effect may be realized, without detriment to the off-gases concentration, by resorting to either of the following expedients:

(a) mixing into the solids feed, or dumping separately into the converter, solids which do not contribute to any appreciable extent to the exothermic smelting reaction, for example, scrap metal or process dust which is mainly oxidic in nature; or (b) injecting into the converter some water, as a separate stream from the concentrate-flux-oxygen stream in an amount suitable to maintain an autogenous smelt, the oxidizing gas being injected in a proportion greater than that needed to maintain the autogenous smelt in the absence of water.

Moreover, if some dilution of the off-gases can be tolerated, the desired cooling may be achieved by the addition of air to the oxygen stream. If, on the other hand, the concentrate in question, though ignitable, does not supply heat to make the smelting fully autogenous, auxiliary heat can be supplied by injecting fuel, such as coal dust, into the vessel. Such fuel may be introduced through a separate burner, or it may be blended with the concentrate-flux mixture to be smelted.

It will be understood from the above that the reduced size of the flame-zone resulting from the use of burners having a length to diameter ratio which is about an order of magnitude greater than the ratio used in conventional burners, can be taken advantage of either:

(a) by practicing the invention in an otherwise conventional furnace whereby greater flexibility is gained in the positioning and directing of the burners and improved refractory life can be obtained; or (b) by practicing the invention in small vessels where conventional flash-smelting would be impracticable. It should be emphasized that use of small vessels to carry out the process results in more than a mere scaling down of operations. In fact it enables a higher smelting rate per unit volume of furnace space. Thus, whereas the large furnace described above operates in such a way that about 2.4 tonnes of concentrate are smelted per day per cubic meter of furnace space, we have used a small converter to smelt 4 or as much as 16 tonnes of concentrate per day per cubic meter of furnace space.

A copper recovery process embodying the present invention comprises flash-smelting a sulfide concentrate using pure oxygen, tapping off the resulting slag and then blowing the matte with air or oxygen in the same vessel. The slag tapped off may be slowly cooled, finely ground and subjected to froth flotation to recover a fraction containing most of the copper present in the slag. This fraction can then be recycled by mixing it with further concentrate to be smelted.

In the case of treatment of nickel sulfide concentrates a similar procedure to the above would be used, except that the slag treatment might comprise reducing it in an electric furnace to recover a low grade matte which can then be fragmented and mixed with primary concentrate to be smelted.

Dust which is generated in the reactor and carried out by the off-gases can be collected with the aid of conventional electrostatic precipitation. This dust can then be mixed-in with primary concentrate feed and acts as a coolant when high grade matte is aimed at. We have found surprisingly that the extent of dust generation within the reaction vessel is not significantly increased by the direct feeding of dust mixed with the concentrate.

By way of example, test results are given below which illustrate the flash-smelting of a copper concentrate in a top-blown rotary converter in accordance with one aspect of the invention.

EXAMPLE 1

The vessel used was a pilot-sized top-blow rotary converter of nominal 10 tonne capacity. It was modified by installing a burner through its hood alongside the normal lance. The burner used was of similar design to that illustrated in the drawing and the mixing tunnel thereof was provided by a water-cooled tube 183 cm long of 5.8 cm internal diameter, i.e., its length to diameter ratio was over 31. The feed was made up of a mixture of a copper concentrate containing 29.8% copper and 33.1% sulfur, together with 96% silica flux and dust collected from an electrostatic precipitator. (All percentages herein are percentages by weight). The relative amounts of concentrate, flux and dust were in the ratio 100:12.8:10.7 by weight.

The solid mixture was injected through the burner with the aid of commercially pure oxygen, the latter being used in an amount corresponding to 38% by weight of the concentrate. The suspension was forced through the burner at a rate corresponding to a linear velocity of 30.8 m/sec, and a concentrate feed rate of 1,200 kg per hour. At this feed rate the efficiency of utilization of furnace space could be expressed as about 4 tonnes of concentrate smelted per day per cubic meter.

The visible portion of the flame had a divergence, near the tip of the burner, of about 6°. Temperature measurements within the flame showed that the temperature had reached 1455° C. at a distance of 0.9 m from the tip, indicating very rapid reaction. Using an iron spoon, samples of material were collected from the flame-zone at 0.3 m as well as at 2.1 m from the burner tip. The sample collected at 0.3 m analyzed 32% copper and 20% sulfur, while the material adhering to the spoon at 2.1 m from the tip was essentially slag containing 6.7% copper, 40% iron, 30% silica with only 0.8% sulfur.

The smelting was continued for 8.6 hours, and proceeded autogenously throughout the period. The resulting bath was found to be at 1410° C. Slag and matte were separated and analyzed. The slag was found to contain 7% copper and 28% silica, while the matte analyzed 75% copper, 0.6% iron and 18.5% sulfur. Dust collected from the converter during the smelting amounted to 4.6% of the weight of concentrate smelted.

EXAMPLE 2

The vessel as used for Example 1 above was modified by replacing the burner by a slightly wider one having a mixing tunnel with a length to diameter ratio of 23. The same solids mixture was injected at the rate of 2000 kg per hour and at a linear velocity of 32.9 m/sec through this burner. This feed rate amounted to a very high furnace space utilization of about 7 tonnes of concentrate per day per cubic meter, and because heat losses were proportionally lower at this feed rate, water cooling was resorted to. To this end an amount of water equivalent to 10% of the concentrate weight was injected separately into the converter during the smelting operation.

At the end of the smelting, the bath was at 1305° C. Slag containing 6.5% copper and 31% silica was skimmed off, and the matte, which analyzed 78.9% copper and 17% sulfur, was subsequently converted to a blister copper in the same vessel.

While the implementation of the invention in a top-blown converter has been specifically described, it should be emphasized that a particular benefit can be realized when the invention is carried out in a side-blown vessel. This is because with such a vessel, if smelting were to be carried out by injection of gases through the tuyeres, the potential erosion of the latter prevents the use of a sufficiently high level of oxygen enrichment to achieve autogeneity, so that extra fuel would be needed. In contrast, the ability to flash-smelt in such a converter permits the use of the higher level of oxygen-enrichment needed for autogeneity.

Although the present invention has been specifically described with reference to preferred embodiments thereof, it will be understood that various modifications may be made to the details of such embodiments without departing from the scope of the invention, which is defined by the appended claims.

We claim:

1. In a process for flash-smelting sulfides by suspending the sulfides together with a fluxing agent in an oxidizing gas stream containing free oxygen and injecting the suspension into a furnace chamber, wherein formation and injection of said suspension is accomplished by at least one burner which comprises a first conduit through which particulate sulfide and fluxing solids are fed, a second conduit through which oxidizing gas is fed, and a mixing tunnel having an inlet extremity which communicates with said conduits to receive said particulate solids and oxidizing gas and an outlet extremity which communicates with said furnace chamber to discharge said suspension thereinto;

the improvement wherein said mixing tunnel comprises a tunnel cooled by water or other suitable fluid and having a length of at least ten times its internal diameter, and wherein said suspension is injected through said tunnel at a linear velocity of at least 25 meters per second.

2. A process as claimed in claim 1 wherein said mixing tunnel has a length of at least 20 times its internal diameter.

3. A process as claimed in claim 1 wherein said linear velocity is at least about 30 meters per second.

4. A process as claimed in claim 1 wherein said oxidizing gas stream comprises commercially pure oxygen or oxygen-enriched air.

5. A process as claimed in claim 1 wherein smelting is effected in a furnace of elongate horizontal cross-section, having a pair of opposed, essentially vertical end-walls, at least one of which is adapted to receive therethrough said burner or one of said burners.

6. A process as claimed in claim 5 wherein said furnace comprises a conventional side-blown converter adapted to receive said burner or burners.

7. A process as claimed in claim 1 wherein smelting is effected in a furnace which comprises a generally cylindrical vessel, closed at one end of its longitudinal axis, and open at the opposite end of said axis, said vessel being mounted such that said axis is disposed at an acute angle to the vertical, and wherein said furnace includes means for supporting said burner within said open end of said vessel such that said oxidizing gas stream is injected in a countercurrent direction to off-gases exiting from said vessel in operation.

8. A process as claimed in claim 7 wherein said furnace comprises a conventional top-blown converter adapted to receive said burner.

* * * * *